United States Patent [19]

Mills et al.

[11] Patent Number: 4,704,560

[45] Date of Patent: Nov. 3, 1987

[54] VACUUM FLUORESCENT DISPLAY SYSTEM, DIGITAL POWER SUPPLY

[75] Inventors: John E. Mills, Royal Oak; Michael A. Dahl, Southfield, both of Mich.

[73] Assignee: Chrysler Motors Corporation, Highland Park, Mich.

[21] Appl. No.: 915,431

[22] Filed: Oct. 6, 1986

[51] Int. Cl.[4] ..... G09G 3/10

[52] U.S. Cl. ..... 315/169.3; 315/169.4; 315/307

[58] Field of Search ..... 315/169.3, 307, 169.4

[56] References Cited

U.S. PATENT DOCUMENTS 4,178,593 12/1979 Kishino et al. ..... 315/169.4

4,472,660 9/1984 Knothe et al. ..... 315/169.4

4,642,524 2/1987 Eaton et al. ..... 315/169.3

*Primary Examiner*—Harold Dixon

*Attorney, Agent, or Firm*—Wendell K. Fredericks

[57] ABSTRACT

A digital pulsewidth modulator switch regulator is used in a power supply for a multisection vacuum fluorescent display system. Pulsewidth modulations are based on grid and anode load characteristics of each section of the display, stored prior to system operations in a designated location of memory of a microcomputer used for controlling switching regulations. Display voltage updates are made utilizing the stored data as well as new load data derived from the power supply output voltage feedback signals indicative of changes in the display voltage.

4 Claims, 4 Drawing Figures

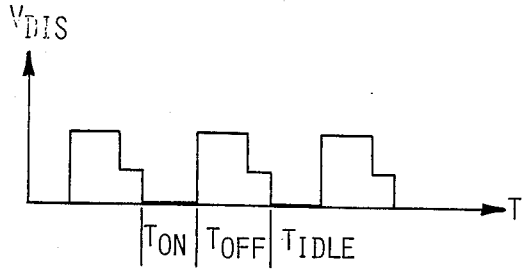
Fig-2
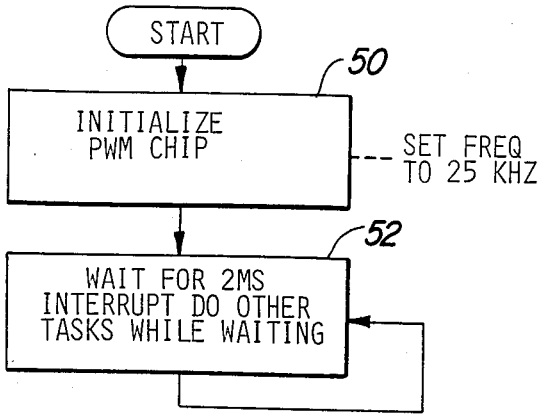
Fig-3
Fig-4
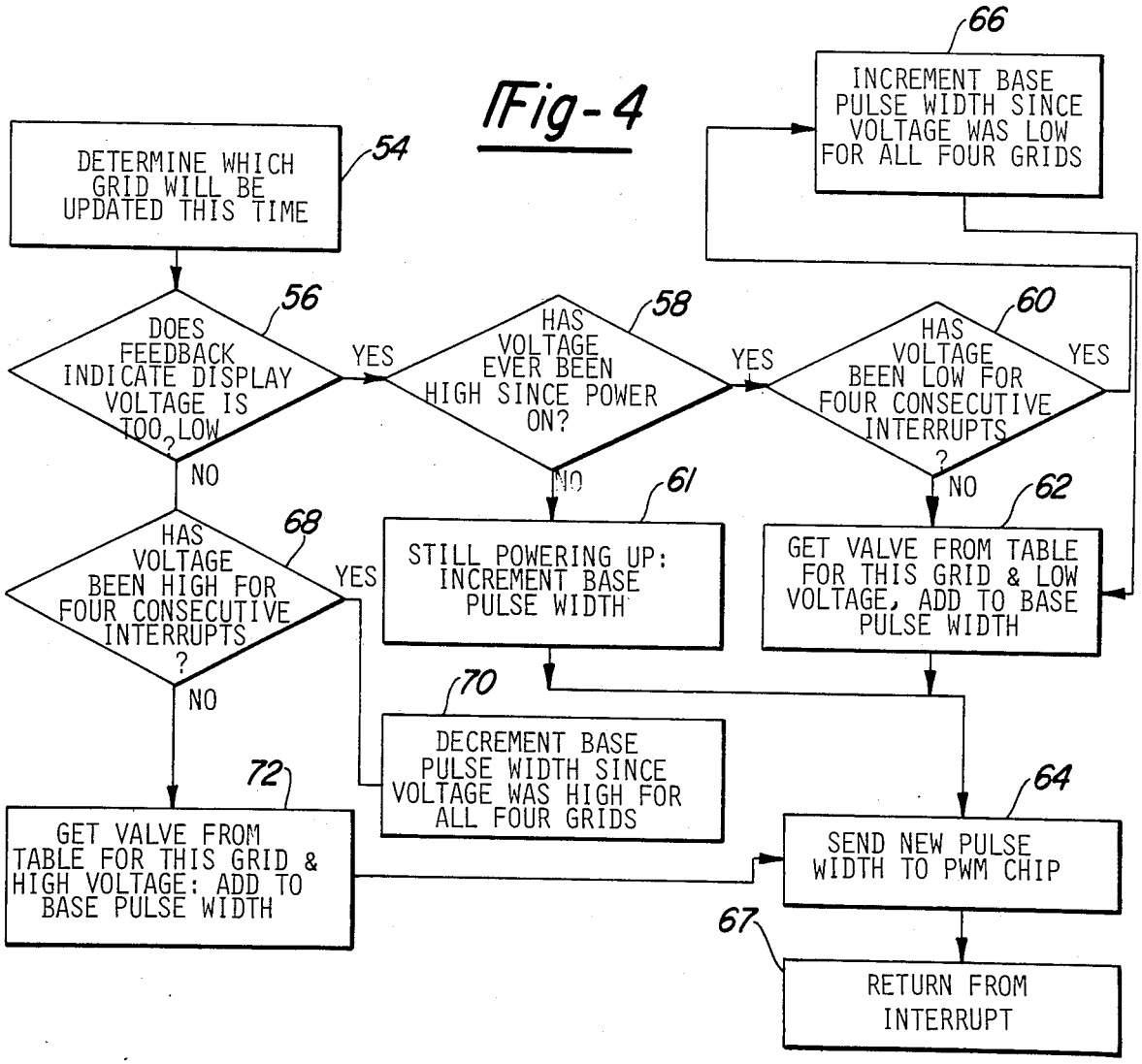

VACUUM FLUORESCENT DISPLAY SYSTEM, DIGITAL POWER SUPPLY

BACKGROUND OF THE INVENTION

1. Field of the Invention

This invention relates generally to switching power supply systems employing voltage regulating techniques for controlling voltages supplied to vacuum fluorescent displays (VFD) and more particularly to improved switching power supplies and voltage regulation techniques therefor which control brightness of individual sections of multisection VFDs.

2. Description of the Prior Art

In prior art multisectioned VFD systems, it is well-known that such displays may have several sections with a grid for each section requiring power wherein one section may house circuitry for five illustrating characters while another may house circuitry for only one character. Each character is formed from a combination of anode segments and if the character is considered a standard character usually it is composed of seven (7) anode segments.

If in a multisection system, e.g., there are four sections and the first three sections include two standard characters for display while the last includes one standard character and four non-standard characters, then the first three sections would in most instances, require from a power supply less anode and grid power per section than the last one because of the fewer anode segments. In most multisection display systems, section displays are generated sequentially from the first section to the last by energizing in turn each control grid while up-dating the anode segment information needed for the characters to be displayed. Since the grid loads may vary, but the grid voltage must remain substantially constant, various schemes have been devised to compensate for the variations.

Analog type pulsewidth modulator circuits using have been utilized to drive cup core type transformers. However, such systems have a disadvantage in that they cannot anticipate changing grid loads.

Other prior art systems have used microcomputers to control a switching power supply wherein the output voltage applied to the grids is sensed and converted to a digital equivalent voltage and fed back to the microcomputer for updating the grid voltages. Such systems provide effective control of grid voltages but usually an A/D port of the microcomputer is utilized which might otherwise be used for some other application and usually the associated components such as the transformers, even if it is a cup, core type, usually are large and bulky, consuming an inordinate amount of space.

Realizing problems such as the inconvenience of having to obtain a microcomputer with an A/D converter port, a search for various other means to effect controlling power to multisection displays was initiated. This search resulted in the improved system of the present invention.

BRIEF SUMMARY OF THE INVENTION

The present invention is concerned with systems for controlling grid and anode voltages by using primarily digital control means along with a conventional microcomputer. Predetermined grid and anode voltages are stored in a look-up table in the microcomputer and is used as a reference for modifying the output of a digital pulse width modulator to provide regulated voltage signals to each grid and preselected anode segments of each section of the vacuum fluorescent display.

BRIEF DESCRIPTION OF THE DRAWING

Referring to the drawing figures in which like numerals represent like parts in the several views:

FIG. 2 depicts a discontinuous waveform of the discontinuous type power supply of this invention;

FIG. 3 is a short flow chart indicative of routine used by the microcomputer of this invention to control the various grid currents; and FIG. 4 is another flow chart showing an interrupt routine used by the microcomputer of this invention to regulate the display voltage.

DETAILED DESCRIPTION OF A PREFERRED EMBODIMENT

Figure 1:
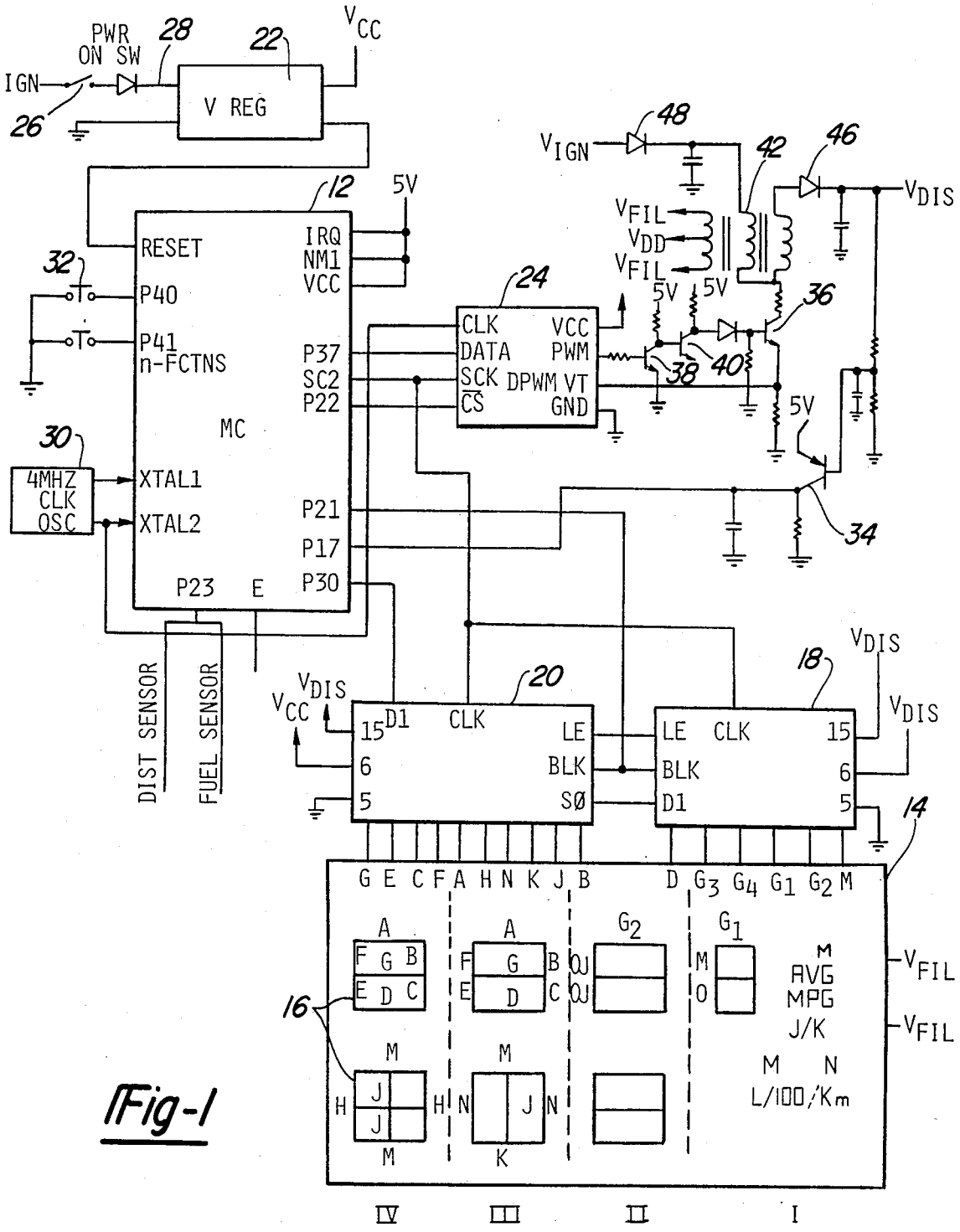
FIG. 1 is a schematic diagram of a vacuum fluorescent display power supply system which sets the operating environment for the system according to the invention.

FIG. 1 is a schematic diagram of a preferred embodiment of a digitally controlled vacuum fluorescent display system. System 10 may be employed; e.g. in an instrument panel of a motor vehicle equipped with vehicle electronics and instrumentation to provide visual displays of a variety of information related to the condition and operation of the motor vehicle.

Illustratively, distance sensor and fuel sensor data may be fed into an "R-DATA" port 23 on microcomputer (MCU) 12. MCU 12 is programmed to convert these two parameters into five function displays such as "Distance to Empty", "Avg. MPG", "ODO", and "Elapsed Time". This type of information can then be visually displayed on multisection display 14.

Display 14 contains four sections, namely I through IV. It should be appreciated that more or less sections could be used. Each section contains Characters 16-1 for displaying information. Each section II - IV contains at least two of the well-known standard seven (7) segment characters; while section I contains one standard seven (7) segment character and three information characters comprised of several non-standard segments.

As in most VFD's, the segments are anode electrodes, each of which may be individually programmed to permit forming a variety of displayable alphanumeric characters or symbols.

Not shown but indicated by the letter G, are four separate grids G1–G4, one for each section of the display. Each grid is sequentially powered by voltage produced by circuits within system 10. Also not shown are a plurality of filament wires which span all four sections of display which can be heated by voltages also generated within system 10 to a subluminous temperature. At that temperature, a coating on the filaments produce free electrons which are accelerated by an electric field produced by the voltage on the control grids. The grids consist of fine wire mesh that allows electrons to pass through and be attracted to the selected anode segments which had been programmed to receive anode voltages.

A pair of conventional display drives 18 and 20 are used in system 10. Driver 18 is used primarily to control multiplexing grid voltage to the sequentially selected grids and to control multiplexing anode voltage to certain selected anode segments. Driver 20 is used exclusively to control multiplexing anode voltages to selected anode segments. A portion of the main computer program stored in MCU 12 selects anode segments to be energized and orchestrates the sequential activation of the control grids. Anode segment and grid sequencing data is routed to the drivers via a "data-in" (DI) port on driver 20 from a "data-out" port P30 of MCU 12. A "SO" port on driver 20 is used to transfer the sequential grid control data and anode segment data to a data-in (DI) port of driver 18. The logic circuits in drivers 18 and 20 require 5 VDC supply power.

Voltage regulator circuit 22, which is a low dropout 5 VDC voltage regulator such as a SGS model L487 is used to supply the system power. Such a regulator can work correctly providing a precise output voltage of 5 VDC+2.5% which the input voltage falls as low as 6 volts. When operating, regulator 22 supplies 5 VDC system power (VCC) to drivers 18 and 20, MCU 12 and a digital pulse width modulator (DPWM) 24. Regulator 22 is activated when a "power on" switch 26 is turned on to apply an unregulated DC voltage; e.g., 12 V ignition power, to a power input terminal 28.

In addition to powering the above-mentioned devices, regulator 22 provides, after an externally programmed delay, a RESET signal (LO) to reset MCU 12 during a power-on phase. The RESET signal which is applied to RES terminal of MCU 12 is a delayed signal (e.g., 10 MS) allowing DPWM 24 and display drivers 18 and 20 to become fully operable prior to being subjected to MCU control. After the delay, RES goes H1 then MCU 12 starts executing a factory installed program (the main software program) stored in ROM of MCU 12.

MCU 12, e.g. is a single chip 8-bit unit such as a Motorola MC 6801 microcomputer chip containing a CPU, on-chip clock, ROM, RAM, a serial communications interface, I/O and a timer. The on-chip clock is controlled by an external oscillator providing a clock signal, e.g. of 4 MHz. Ports 2, 3 and 4 of MCU 12 are used for interface purposes. P37 transfers serial data to DPWM 24, SC2 strobes the serial data from P37 to DPWM 24 and from P30 to display drivers 18 and 20; P22 selects and deselects DPWM 24; P21 blanks the display every 2 ms for about 40 microseconds; terminal E of MCU 12 synchronizes the clocking of distance and fuel sensor data into P23; P40 accepts U.S. or metric choice of characters to be displayed from SELECT push button 32; P41 accepts the sequential selection from another push button 33 of five different functions namely (1) distance to empty, (2) AVG MPG, (3) instantaneous MPG, (4) "ODO": and (5) elapsed time; and P17 receives a feedback logic "1" or "0" signal from a PNP switching transistor 34 indicative of whether display voltage (Vdis) is above or below the desired output levels.

DPWM 24, e.g. is a integrated circuit chip made by RCA of Sommerville, N.J. that includes an on-chip clock which is also controlled by the external oscillator 30. In addition to the several terminals previously mentioned, DPWM 24 has a PWM output terminal which provides the pulsewidth modulated switching signal to a base of a conventional NPN switching transistor 38. Also, DPWM has a VT input terminal which accepts an analog feedback signal from terminal T of an emitter circuit of a NPN power transistor 36 indicative of an over voltage signal being sent from DPWM.

Upon power up of system 10; the output of DPWM 24 is at a logic zero state and remains there until a SELECT signal from P22 of MCU 12 is issued enabling DPWM 24. Twenty-four bits of data is sequentially transferred from P37 to DATA input terminal of DPWM 24 into shift registers, each bit being clocked in response to the rising edge of the clock signal from SC2 terminal of MCU 12. The twenty-four bits of data is formatted such that the first eight bits contain the power up/down and clock divider information, the second eight bits contain the frequency data and the third eight bits contain the PWM data. This data in the shift registers is transferred to a control, a frequency and a PWM registers within DPWM 24 on the falling edge of the twenty-fourth clock pulse. After power-up and the inputting of the data, a deselect signal from P 22 of MCU 12 is sent to the CS terminal of DPWM 24 deselecting the chip. Then the programmed output pulse of a chosen frequency and pulse width issues from the PWM output terminal of DPWM 24. Illustratively, for a typical initial choice, the frequency of the pulse is 25 KHz and the pulses are 20 microseconds wide at a 50 percent duty cycle.

The pulses are used by a special cup core type autotransformer to boost, e.g. 12 VDC input voltage up to about 35 VDC, the grid and anodes of the display needing the 35 VDC. This high frequency pulse is used to gain a cost advantage; e.g. a much smaller transformer can be used at 25 KHz to gain the boost needed to power the VFD than at 2 KHz.

It has been determined that, in order to get the necessary voltage gain for powering transformer 42, a current of about 1.2 amp is needed in the primary winding of transformer 42. The beta of power transistor 36 should be sufficient to amplify a proper base current to realize collector currents suitable to effectively power transformer 42. To obtain the proper base current for transistor 36, two NPN switching transistors 38 and 40 with suitable betas are connected in series so as to develop a high base current from the pulse signal issued by DPWM 24. The PWM output from DPWM 24 is applied to the base of transistor 38. The inverted and amplified output of transistor 38, tapped off its collector, is applied to the base of transistor 40 which also inverts and amplifies the pulse and then applies it to the base of power transistor 36 via an isolation diode 44. Transistor 36 amplifies the base current and applies the amplified collector current to the primary (NI) and a secondary (N2) winding of transformer 42.

Illustratively, transformer 42 may be, e.g. a conventional cup core transformer from TOKO of America, Chicago, Illinois with winding ratios of 50, 50 and 8 for the primary, secondary and filament windings respectively and wound with a number 34 gage wire. The primary and secondary are step-up windings; the filament is a step-down winding.

For successful use of the transformer to boost the voltage, it is necessary to store voltage in the primary winding while the power transistor 36 is on and to transfer that power to the secondary winding when transistor 36 is off. As shown in FIG. 1, the collector of transistor 36 is connected directly to a first end of the primary winding (N1) of transformer 42. Illustratively as shown in FIG. 2, when transistor 36 is on 12 V is applied to another end of primary winding N1 and current flows and voltage is stored in winding N1 due to inductive action of winding N1. The secondary winding N2 acts as if it is the secondary winding of the transformer; thus, current flow and polarity of winding N2 is opposite of that for winding N1. A diode 46 at the output end of winding N2 is reversed bias and blocks the flow of current from transformer 42. Then during the on period of transistor 36, current increases in winding N1. When transistor 36 is OFF, a voltage is induced in N2 causing current to flow in it and through diode 46 which rectifies the voltage generating Vdis which is applied to its load, its load being the display device. Before transistor 36 turns ON again, the voltage dissipates and an idle period occurs.

A capacitor at the output of diode 46 is used to supply power to VFD during idle and OFF times. Also with a display voltage at the output of diode 46 of 35 VDC, there occurs a ripple voltage of approximately 1.25 volts peak to peak. This occurs due to the discharge of the capacitor and the pulsewidth error.

The output voltage Vdis is applied simultaneously to the selected grid and anode segments of display 14 via display drivers 18 and 20. As mentioned, supra, programming signals from port P30 are used to sequentially select the grid are which used to control illumination of the characters defined by the multiplexed groups of anode segments. Illustratively Vdis which is, e.g. 35 VDC, is applied to both the selected grid and the selected anode segments to illuminate the desired characters and symbols. A filament voltage for the display is obtained from the step-down winding N3 and is approximately 2.2 vac.

The operation of digitally controlled vacuum fluorescent display system 10 will now be discussed. Assuming all four sections of display 14 are to be used to display in response to pressing push buttons 32 and 33. Because the load created by the grid and the anode segments in each section may be different, the impedance of all four sections are determined and stored in a "look-up" table in a section of memory of MCU 12 and this information becomes a part of the factory installed program used by system 10. Because system 10 is connected parallel with the ignition voltage, 12 VDC is applied to voltage regulator 22 and transformer 42 via a diode 48. The 5 VDC system power from regulator 22 is applied to MCU 12, DPWM 24 clock drivers 18 and 20, and the switching transistors, but RES terminal at MCU is held low for approximately 30 ms. to allow DPWM 24 to become fully operable. After the 30 ms, MCU 12 initiates the sequence of programs that are stored in ROM.

With reference now to FIG. 3, the sequence of instructions of a main program executed by MCU 12 is shown. With reference to instructional block 50, to initialize DPWM 24, MCU 12 selects DPWM 24 and sends it the initial twenty-four bits of control, frequence and PWM data. After DPWM 24 sorts out the data, MCU then deselects DPWM 24. Illustratively, a 25 KHz 20 microsecond wide pulse signal issues. Once the frequency of the pulse is established, only the pulse width or time of the pulse is altered. As indicated in block 52, the main program is interrupted and the interrupt program of FIG. 4 is executed every 2 ms. 8 ms are used to complete the display of all four sections.

Since all four sections of the display are used, each grid is sequentially supplied display voltage Vdis, during an interrupt routine. MCU 12 determines, as in block 54, which grid is first in the sequence to receive power. Serial data from P30 of MCU 12 is routed to clock drives 18 and 20 to activate the logic which connects the first grid in the sequence and the anode segments in the first section of the display to receive the 35 VDC display voltage Vdis. The program then proceeds to decision block 56 wherein a check is made through port 17 of MCU 12 using the feedback signal from Transistor 34. As to the status of Vdis, if MCU 12 receives a high signal from transistor 34, indicating power to grid I must be increased, another decision is made by MCU 12 as in block 58 as to whether Vdis had been high since power-on. If NO, the program proceds to instruction block 61. Memory slots are used to compile a history of the voltage levels of each grid during each interrupt. Since this is the initial interrupt, there is no history of grid voltages. If a history of high voltages for Grid I existed, MCU 12 would determine, as in decision block 60, whether or not the grid voltage had been low for four consecutive interrupts. If the voltage had not been low, then MCU 12 would, as in instruction block 62, go to a look-up table and get the proper value in the table for grid I and the low voltage reading, and then determine how much the base pulse width must be increased to generate an increased voltage signal to grid I. If the voltage was low for four consecutive interrupts, then the base pulse width would be incremented as in instructional block 66 since the voltage had been low for all four grids. Then the program would go to instruction block 62. Then MCU 12 will send a new pulse width 8-bit word to DPWM 24 to update grid I. After grid I is updated, as in block 67, MCU 12 returns to the main program. MCU 12 issues from port P21 a blanking signal which blanks the display for about 40 microseconds. Then the next interrupt routine is initiated. Before leaving the first interrupt and returning to decision block 56, if the feedback voltage from transistor 34 indicated that Vdis is not too low, then another decision would be executed, as in decision block 68, to determine if the voltage had been high for four consecutive interrupts. If so, then as in instruction block 70, an instruction would be carried out to decrement by one the base pulse width since the voltage was high for all four grids. If the voltage had not been high for four consecutive interrupts, then the instruction in block 72 is performed to get the value from the look-up table for this grid and the high voltage and then add the value to the base pulsewidth. Then an instruction to send the new pulsewidth to DPWM 24 would be performed as in block 64.

The main program and the interrupt routines are continuously executed dring operation of system 10.

What is claimed is:

1. A digital controlled switching power supply system for powering a multisectioned vacuum fluorescent display (VFD) system in a motor vehicle, said VFD comprising at least two sections, each section having a grid and a plurality of anode segments for forming a plurality of characters and symbols, each of the sections representing individual load requirements which said power supply separately encounters during operation, the motor vehicle providing an unregulated input voltage for operating said power supply system, said power supply system comprising:

(a) voltage regulator means connected to the unregulated input voltage for generating a precised regulated output voltage for use within said switching power system, said voltage regulator means including means for initiating a delayed reset signal indicative of presence of the supply voltage;

(b) a transformer means also connected to the unregulated input voltage for stepping up the unregulated voltage to a particular multiple value for supplying power to the grid and anode segments of each section of the VFD and for stepping down the unregulated voltage to a particular value for supplying power to the filaments used by the VFD, one end of a primary (N1) winding of said transformer means being connected to the unregulated input voltage and one end of a secondary winding being an output of said transformer means;

(c) pulsewidth modulator (PWM) means having an output connected to another end of said primary (N1) and another end of said secondary (N2) winding of said transformer means for providing pulses of a particular frequency and of modulating pulsewidth so as to cause said transformer means to develop the stepped up voltage for powering the grid and anode segments of each section of the VFD;

(d) multiplexing means with multiplexed output lines connected to the VFD for applying grid and anode voltages to preselected grid and anode segments of the VFD;

(e) a rectifier circuit connected between the output of said transformer means and a display voltage input of said multiplexing means for providing a rectified display voltage to said multiplexing means;

(f) microcomputer means interconnecting said pulse width modulating means and said multiplexing means for determining individual grid and anode voltages relative to grid and anode segment load data, and then providing serial data to said PWM means providing a pulse of a particular frequency and of a pulsewidth modulated so as to pulse the primary N1 and secondary (N2) windings in a manner which modifies the display voltage from said transformer means to be in coincidence with the voltage values determined from the load date, and for sequentially selecting each grid and simultaneously selecting the anode segments and then providing serial data to said multiplexing means for transferring the display voltage to the selected grid and coselected anode segments.

2. Apparatus in accordance with claim 1 wherein said PWM means includes a digital pulsewidth modulator and switching circuitry capable of amplifying the PWM signal from said digital pulsewidth modulator.

3. Apparatus in accordance with claim 1 wherein said multiplexing means is a pair of display drives, one of said pair being used to multiplex the display voltage to each of the sequentially selected grids and another of said pair being used to multiplex the display voltage to the preselected anode segments in each VFD section simultaneously with the sequential selection of each grid.

4. A method of modulating a pulsewidth in a switching power supply system for a multisection vacuum fluorescent display (VFD) system wherein a digital feedback signal is fed back to a microcomputer indicative of the status of an output display voltage signal, wherein each section of said VFD includes a grid and a plurality of multiplex anode segments wherein the microcomputer provides a serial digital signal to a digital pulsewidth modulator for adjusting the pulsewidth of a pulse signal used to switch current flow in an autotransformer of said switching power supply, said microcomputer having memory slots designated for storing output voltage status during operation of the power supply system, the method comprising the steps of:

(a) prior to operating said system, storing in a memory location of said microcomputer in the form of a lookup table, grid and anode segment load and voltage requirements;

(b) sequentially applying the display voltage signal to the grid and multiplex anode segments of each section of the VFD;

(c) feeding back a digital signal indicative of the status of the display voltage signal coincident with the sequential application of the display voltage signals to VFD sections;

(d) storing each status of said display voltage signal in a designated portion of memory so as to develop a history of load and voltage variations of each section of the VFD during operation;

(e) combining the lookup table data of load and voltage requirement with the operating history load and voltage variations so as to obtain time values that the microcomputer can use to provide an adjusted serial digital signal to regulate the width of the pulses form the digital pulsewidth modulator coincident with each application of the display voltage signal to each VFD section.

* * * * *